US005360116A

United States Patent [19]

Schmiletzky

[11] Patent Number: 5,360,116

[45] Date of Patent: Nov. 1, 1994

[54] BLISTER PACK WITH A TEAR-OFF AID

[75] Inventor: Dieter Schmiletzky, Worblingen, Germany

[73] Assignee: Alusuisse-Lonza Services Ltd., Zurich, Switzerland

[21] Appl. No.: 968,272

[22] Filed: Oct. 29, 1992

[30] Foreign Application Priority Data

Nov. 18, 1991 [CH] Switzerland ..... 3362/91

[51] Int. Cl.[5] ..... B65D 83/04

[52] U.S. Cl. ..... 206/531; 206/532

[58] Field of Search ..... 206/531, 532, 469, 828, 206/461; 221/302

[56] References Cited

U.S. PATENT DOCUMENTS

| | | | |
|---|---|---|---|
| 3,759,371 | 9/1973 | Marks | 206/531 |
| 3,912,082 | 10/1975 | Gerner et al. . | |
| 3,941,248 | 3/1976 | Moser et al. | 206/531 |
| 4,567,986 | 2/1986 | Eastwood | 206/531 |
| 4,911,304 | 3/1990 | Bunin | 206/531 |
| 5,014,851 | 5/1991 | Wick | 206/531 |
| 5,109,984 | 5/1992 | Romick | 206/531 |
| 5,150,793 | 9/1992 | Tannenbaum | 206/531 |

FOREIGN PATENT DOCUMENTS

| | | |
|---|---|---|
| 1288979 | 2/1969 | Germany . |
| 1486667 | 10/1969 | Germany . |
| 9000386 | 5/1990 | Germany . |

*Primary Examiner*—Paul T. Sewell
*Assistant Examiner*—Thomas P. Hilliard
*Attorney, Agent, or Firm*—Bachman & LaPointe

[57] ABSTRACT

Blister pack, of a single type of material, comprising a base section containing one or more compartments, recesses or cups and a cover, which can be peeled off, fitted around the rims of the one or more compartments or cups, the cover being divided into cover segments, each cover segment covering one compartment and the base of each cover segment being sealed around the circumference of the compartment and each cover segment containing a tear-off aid and it being possible for each cover segment to be completely or partially peeled off, pulled off or detached from the circumference of the compartment via the seal seam by pushing the contents through the segment, and base section and cover containing identical or different materials and the materials essentially consisting of the same types of plastics.

9 Claims, 4 Drawing Sheets

BLISTER PACK WITH A TEAR-OFF AID

BACKGROUND OF THE INVENTION

The present invention relates to a blister pack comprising a base section containing one or more compartments, recesses or cups and a cover, which can be peeled off, fitted around the rims of the one or more compartments, recesses or cups.

Packaging of this type is known, for example, for receiving substances shaped in tablet-like form. Each of the individual compartments, recesses or cups can be provided with, in each case, one tablet or the like and the packaging can then be sealed with a cover. Usually, the cover is sealed on plane surfaces provided for this purpose on the upper outer edge and dividing ridges which may be present. Thus, the entire packaged material is sealed tight against the exterior and the various packaged goods in the various compartments are mutually separated from one another, likewise in a tight manner.

Packaging units of this type are known as push-through packs or blister packs, provided the packaged material can be removed by manually pressing in the base section or cup base and pushing through the cover section.

The blister packs which have been disclosed hitherto as a rule have a base section made of plastic or a plastic composite and a cover, for example made of aluminum foil or an aluminum-containing foil composite. When the packaging material is recycled, waste products of different material types are obtained, some of which are still adhesively bonded to one another, such as, for example, various plastics and metals bonded in laminate form.

SUMMARY OF THE INVENTION

The aim of the present invention is to provide a pack which does not have the said disadvantages, that is to say is made of a single type of material, and which permits easy removal of the contents by pushing the contents through the cover.

This is achieved according to the invention in that the cover is divided into cover segments, each cover segment covering one compartment and the base of each cover segment being sealed around the circumference of the compartment and each cover segment containing a tear-off aid and it being possible for each cover segment to be completely or partially peeled off, pulled off or detached from the circumference of the compartment via the seal seam by pushing the contents through the segment, and base section and cover containing identical or different materials and the materials essentially consisting of the same types of plastics.

BRIEF DESCRIPTION OF THE DRAWINGS

The following Figures illustrate the present invention in more detail.

DETAILED DESCRIPTION OF PREFERRED EMBODIMENTS

Figure 1:
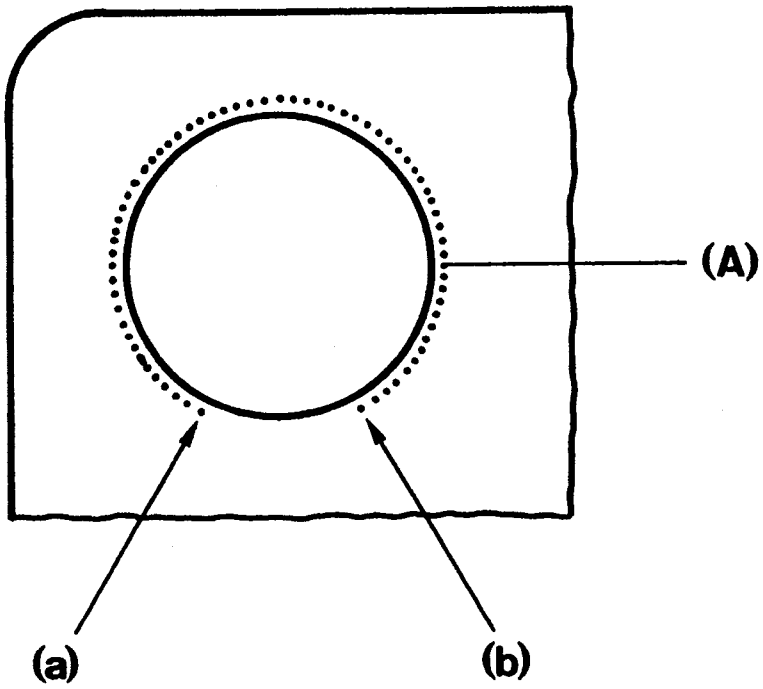
FIG. 1 shows a plan view of a section of a blister pack.
Figure 1A:
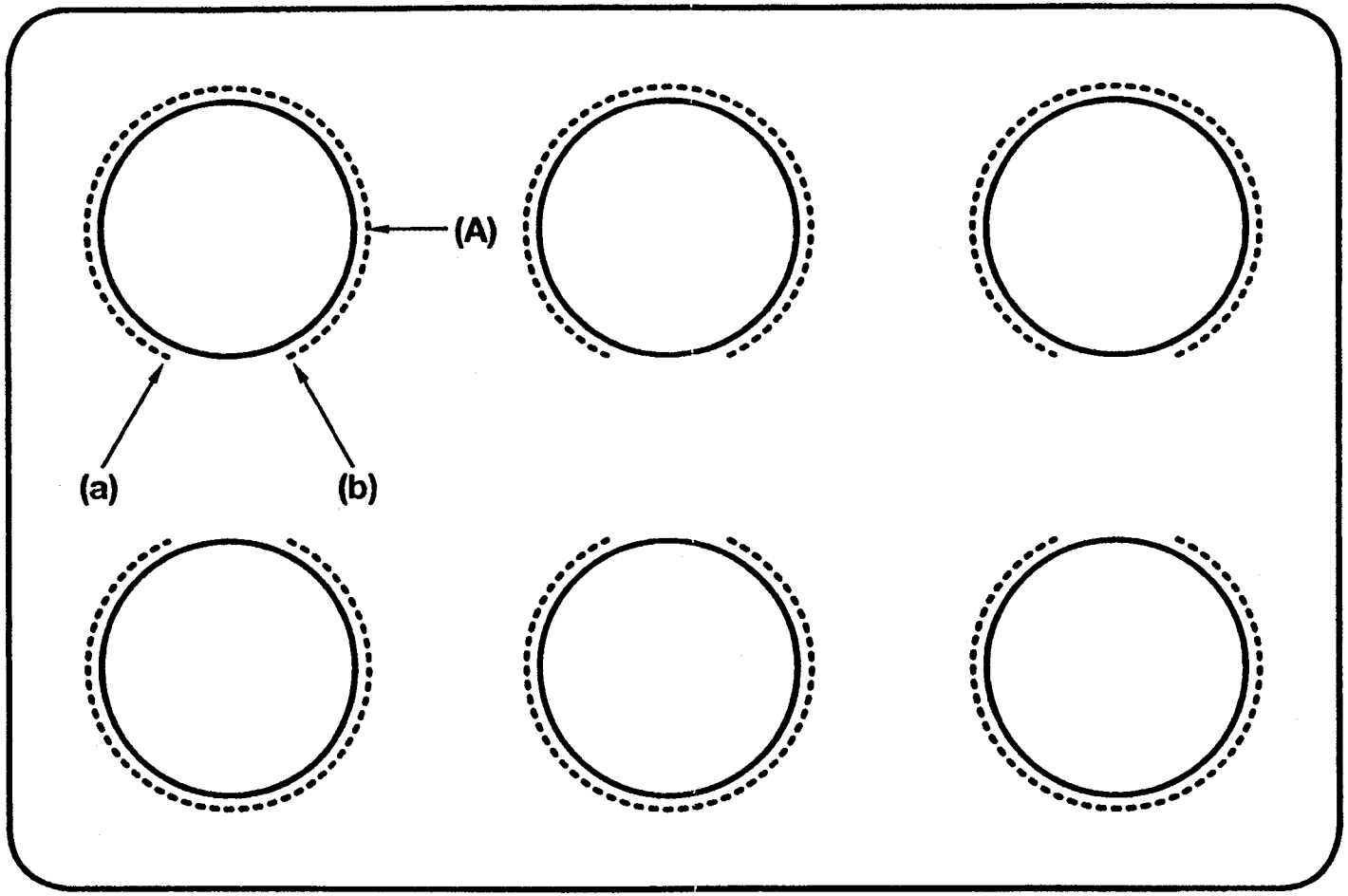
FIG. 1a shows a plan view of a blister pack containing more than one compartment.

In plan view, suitable shapes of packs according to the invention can as a rule be containers of rectangular shape which have a plurality of, for example, angular, circular or oval recesses, compartments or cups.

Within their outer boundaries, the base sections can be divided into compartments, the number and shape of which is arbitrary. The subdivision within the container can be effected by integrally molded or inserted ridges. The ridges can be produced, for example, by deep-drawing, casting, injection molding or folding in one operation during production of the base section or by subsequent sticking into the base section.

The blister pack expediently has more than two compartments, recesses or cups in the base section and the cover is divided into a corresponding number of cover segments.

Base sections containing 8 to 200 compartments are preferred and containers containing 10 to 40 compartments are particularly preferred.

The diameter or the maximum width and length of a blister pack is not critical per se and is usually 3 to 20 cm. The height of such base sections depends on the requirements in practice and can be, for example, 0.3 to 2 cm. The external dimensions expediently also depend on the prevailing conditions, such as standards and standard sizes.

Depending on the intended use, the strength and the processability, the base sections can be plastic compositions which are cast or deep drawn into shape, or the base sections and the cover materials can, for example, consist of plastic-containing films, laminates, composites or sheet materials.

Such materials, and therefore the said plastic compositions, films, laminates, composites and sheet materials, are known per se and the plastics used to prepare them can be, for example, olefin-based, ester-based or polyamide-based thermoplastics or can be halogen-containing plastics or suitable mixtures thereof.

Examples of olefin-based thermoplastics are polyolefins, such as polyethylene, such as high density polyethylene (HDPE, density greater than 0.944 g/cm$^3$), medium density polyethylene (MDPE, density 0.926–0.940 g/cm$^3$), linear medium density polyethylene (LMDPE, density 0.926–0.940 g/cm$^3$), low density polyethylene LDPE, density 0.910–0.925 g/cm$^3$) and linear low density polyethylene (LLDPE, density 0.916–0.925 g/cm$^3$), polypropylene, poly-1-butene, poly-3-methylbutene, poly-4-methylpentene and copolymers or coextrudates thereof and ionomer resins, such as, for example, of polyethylene with vinyl acetate, acrylic acid, methacrylic acid, acrylates, tetrafluoroethylene or polypropylene, as well as random copolymers, block copolymers or olefin polymers/elastomer mixtures.

Ester-based thermoplastics are, for example, polyalkylene terephthalates or polyalkylene isophthalates containing alkylene groups or radicals having 2 to 10 carbon atoms or alkylene groups having 2 to 10 C atoms which are interrupted by at least one —O—, such as, for example, polyethylene terephthalate, polypropylene terephthalate, polybutylene terephthalate (polytetramethylene terephthalate), polydecamethylene terephthalate, poly-1,4-cyclohexyldimethylol terephthalate or polyethylene 2,6-naphthalenedicarboxylate or polyalkylene terephthalate and polyalkylene isophthalate copolymers, in which the proportion of isophthalate is, for example, 1 to 10 mol %, copolymers and terpolymers, and also block polymers and grafted modifications of the abovementioned substances.

The ester-based thermoplastics are expediently polyalkylene terephthalates containing alkylene groups or radicals having 2 to 10 carbon atoms and polylakylene terephthalate containing alkylene groups or radicals having 2 to 10 carbon atoms which are interrupted by one or two —O—.

Preferred ester-based thermoplastics are polyalkylene terephthalates containing alkylene groups or radicals having 2 to 4 carbon atoms, and polyethylene terephthalates are very particularly preferred.

Amide-based thermoplastics include, for example, polyamide-6, a homopolymer of ε-caprolactam (polycaprolactane); polyamide-11, a polycondensation product of 11-aminoundecanoic acid (poly-11-aminoundecanamide); polyamide-12, a homopolymer and ω-laurolactam (polylaurolactam); polyamide-6,6, a homopolycondensation product of hexamethylenediamine and adipic acid (polyhexamethyleneadipamide); polyamide-6,10, a homopolycondensation product of hexamethylenediamine and sebacic acid (polyhexamthylenesebacamide); polyamide-6,12 a homopolycondensation product of hexamethylenediamine and dodecanedioic acid (polyhexamethylenedodecanamide) or polyamide-6-3-T, a homopolycondensation product of trimethylhexamethylenediamine and terephthalic acid (polytrimethylhexamthyleneterephthalamide), and mixtures thereof.

A non-exclusive list of halogen-containing plastics includes, for example, the polymers of vinyl chloride and vinyl plastics-containing vinyl chloride units in their structure, for example copolymers of vinyl chloride with vinyl esters of alphalic acids, in particular vinyl acetate; copolymers of vinyl chloride with esters of acrylic acid and methacrylic acid and with acrylonitrile; copolymers of vinyl chloride with diene compounds and unsaturated dicarboxylic acids or their anhydrides, such as copolymers of vinyl chloride with diethyl maleate, diethyl fumarate or maleic anhydride; post-chlorinated polymers and copolymers of vinyl chloride; copolymers of vinyl chloride and vinylidene chloride with unsaturated aldehydes, ketones and others, such as acrolein, crotonaldehyde, vinyl methyl ketone, vinyl methyl ether, vinyl isobutyl ether and the like; polymers of vinylidene chloride and copolymers thereof with vinyl chloride and other polymerisable compounds; polymers of vinyl chloroacetate and dichlorovinyl ether, chlorinated polymers of vinyl acetate, chlorinated polymer esters of acrylic acid and alpha-substituted acrylic acids; polymers of chlorinated styrenes, for example dichlorostyrene, chlorinated rubber, chlorinated polymers of chlorobutadiene and their copolymers with vinyl chloride; rubber hydrochlorides and chlorinated rubber hydrochlorides; and also mixtures of the said polymers with one another or with other polymerisable compounds and also the corresponding bromides and fluorides.

The base sections can be produced from these plastics by, for example, casting or injection molding. The cover materials and also the base sections can be produced from films, sheet materials, laminates or film composites containing the said plastics.

The base sections and cover materials can also be produced from or using cellulose-containing materials, such as paper, paperboard, cardboard, paper-containing moulding compositions and the like, or can be reinforced with the aid of such materials.

A gas or vapor barrier layer can also be provided in such films, sheet materials, laminates or film composites. Suitable barrier layers are, for example, ceramic barrier layers and plastic barrier layers.

It is also possible to apply barrier layers, such as ceramic layers, to the surfaces of a cast base section.

Barrier layers, such as ceramic layers, contain, for example, oxides from the group comprising silicon oxides, aluminum oxides, iron oxides, nickel oxides, chromium oxides or lead oxides or mixtures thereof, as well as nitrides or oxynitrides of the said metals and metalloids. Suitable ceramic layers are silicon oxides or aluminum oxides. The silicon oxides can have the formula $SiO_x$, where x preferably represents a number from 1 to 2 and particularly preferably from 1.1 to 1.9 and in particular from 1.2 to 1.7. The aluminum oxides can have the formula $Al_yO_z$, where y/z represents, for example, a number from 0.2 to 1.5 and preferably from 0.65 to 0.85.

The ceramic layer is applied, for example, by vacuum thin layer technology, expediently on the basis of electron-beam evaporation or resistance heating or inductive heating from crucibles, for example onto a plastic layer. Electron-beam evaporation is preferred.

The processes described can be operated reactively and/or with ion support. The ceramic layer can have a thickness of, for example, 5 to 500 nm (nanometers), preferably of 10 to 200 nm and preferentially 40 to 150 nm.

Because of its thin layer and the resulting small amount of material, and also because of the physiologically acceptable properties of, for example, silicon oxides or aluminum oxides, the ceramic layer is not troublesome in a recycled material and has no effect on the single-type nature of the material or on reprocessing.

Plastic barrier layers can consist, for example, of polymers which are particularly gastight and water vapor-tight, or can contain these polymers. Polymers which have particularly advantageous characteristics are, for example, polyvinylidene chlorides, polyolefins, ethylene vinyl alcohol (EVOH), polyvinyl chlorides, acrylonitrile copolymers or biaxially stretched polyethylene terephthalate.

The thickness of an individual plastic film or of the individual plastic films in film composites or laminates can be, for example, 8 to 2000 μm, expediently 8 to 500 μm, preferably 10 to 250 μm and in particular 12 to 25 μm.

The film composites or laminates can have the layer structures known per se, such as, for example, containing at least two plastic layers, or containing at least one cellulose-containing layer and at least one plastic layer.

All materials can be used in the clear, opaque, self-colored or color-coated form. It is thus possible, for example, to produce opaque or non-transparent packaging.

With all embodiments, at least one printed, reverse-printed or colored layer of a material such as, for example, a plastic film can also be provided, at least on the outside.

Sealing layers, for example in the form of sealing coating compositions or sealing films, can be applied to the inside of the base section, at least to the peripheral regions or to the boundary flanges and the ridge regions for support and connection, in a leak-tight manner, to the lid, or also on the entire inner surfaces of the base section.

The sealing layers are known per se and, for example, can contain, or consist of, LLDPE, LDPE, MDPE, HDPE, polypropylene and polyethylene terephthalate and can be in film or coating composition form, and these sealing layers can, for example, have a thickness in the range from 1 to 100 μm. Heat-seal coating compositions known per se can also be used correspondingly.

The various layers and in particular the plastic films or sheets, with one another, or ceramic layers on plastic films or sheets, with one another and mutually, can be processed together to form the laminates or composites using laminating adhesive and/or adhesion promoters and, where appropriate, primer.

Suitable adhesion promoters are, for example, vinyl chloride copolymers, vinyl chloride/vinyl acetate copolymers, polymerisable polyesters, vinylpyridine polymers, vinylpyridine polymers in combination with epoxide resins, butadiene/acrylonitrile/methacrylic acid copolymers, phenolic resins, rubber derivatives, acrylic resins, acrylic resins with phenol or epoxide resins, or silicon-organic compounds, such as organosilanes.

Examples of organosilanes are alkyltrialkoxysilanes containing an amino functional group, alkyltrialkoxysilanes containing an ester functional group, alkyltrialkoxysilanes containing an aliphatic functional group, alkyltrialkoxysilanes containing a glycidoxy functional group, alkyltrialkoxysilanes containing a methacryloxy functional group, and also mixtures thereof. Examples of such organosilanes are γ-aminopropylenetriethoxysilane and N-β-(aminoethyl-γ-aminopropyltrimethoxysilane, γ-(3,4-epoxycyclohexyl)-ethyltrimthoxysilane, γ-glycidoxypropyltrimthoxysilane and γ-methacryloxypropyltrimethoxysilane. These compounds are known per se to those skilled in the art.

EAA (ethylene acrylic acid) or modified polyolefins are preferred.

Examples of modified polyolefins are acid-modified polyolefins and accordingly plastics formed by graft modification of a polyolefin with ethylenically unsaturated carboxylic acids or their anhydrides. Examples which may be mentioned of base polymers for the polyolefins are low density polyethylene, medium density polyethylene, high density polyethylene, linear low density polyethylene, homopolypropylene, ethylene/propylene copolymers, polybut-1-ene, polypent-1-ene, but-1-ene/propylene, copolymers and but-1-ene/propylenes/ethylene terpolymers. Homopolypropylene and ethylene/propylene copolymers are preferred.

Examples of ethylenically unsaturated carboxylic acids or their anhydrides are acrylic acid, methacrylic acid, maleic acid, fumaric acid, crotonic acid, itaconic acid, citraconic acid, 5-norbornene-2,3-dicarboxylic acid, maleic anhydride, citraconic anhydride, 5-norbornene-2,3-dicarboxylic acid anhydride and tetrahydrophthalic acid anhydride. Maleic anhydride is preferred.

The preferred modified polypropylene is an adduct of maleic anhydride and an ethylene/propylene copolymer. Dispersions of modified polyolefins are very particularly preferred. An example of a dispersion of a modified polypropylene is Morprime (trade name of Morton Chemical Division of Norton Norwich Products, Inc.).

Further suitable adhesion promoters are adhesives such as nitrile rubber-phenolic resins, epoxides, acrylonitrile/butadiene rubber, urethane-modified acryls, polyester-copolyamides, hot-melt polyesters, polyisocyanates crosslinked with hot-melt polyesters, polyisobutylene-modified styrene/butadiene rubbers, urethanes, ethylene/acrylic acid copolymers and ethylene/vinyl acetate copolymers.

If, for example, laminating adhesives are used between the plastic layers, the laminating adhesives can contain solvents or can be solvent-free and can also contain water. Examples are solvent-containing or aqueous acrylate adhesives or solvent-free polyurethane adhesives.

Laminating adhesives based on polyurethane are preferred.

The composites and laminates, as mentioned in the present description, can be produced in a manner known per se, for example by coating, coextrusion coating, laminating, counter-laminating or hot calendering.

The packagings under consideration also contain a cover. The cover can be produced from the cover materials mentioned in accordance with the desired strength, deformability and processability.

The base sections and cover of the blister pack according to the invention are made of the same types of plastic. That is to say, base section and cover are, in particular, produced from the same plastics or plastic mixtures, it also being possible for the base section and cover materials to be different provided that the materials consist of the same types of plastic. Thus, example, the base section can be in the form of a cast molding and the cover in the form of a film or laminate, or base section and cover can be produced from films and/or laminates of identical or different structures.

The plastics used for base section and cover of a blister pack according to the invention in each case have only one common, or essentially common, molecular skeleton. Mixtures of plastics which have two or more molecular basic skeletons are also covered. Plastics containing, for example, auxiliaries such as plasticizers, fillers, stabilizers and the like, are also covered. It is essential that the particular plastic or the plastic mixture in the base section and cover of a pack is, in particular, of a single type and recyclable.

In practice, it can be expedient, for example, to provide a rigid or semi-rigid base section and to use a cover in easily bendable, that is to say produced, for example, in the form of a film or from film strip.

Other embodiments can be constructed using a semi-rigid or rigid base section and a semi-rigid cover.

This also permits different effects in the presentation of the pack, such as, for example, an opaque rigid or semi-rigid base section and a transparent, optionally soft, cover.

In order to bond the cover, in particular in a sealing manner, to the base section, the cover can have a sealing layer on the surface of the cover material which comes to lie on the inside of the container. The cover material can optionally also or have a sealing layer on the outside.

Appropriate sealing layers have been illustrated above.

The sealing layer on the inside of the cover can extend over the entire surface thereof or can be present or applied only over part of the surface, in the region of the seal to be made. Accordingly, it is possible for only the base section, in particular on the side facing the cover, or the cover, in particular on the side facing the base section, or both the base section and the cover in each case to have a sealing layer, such as a sealing film and/or a sealing coating composition.

As mentioned above, the cover can be produced from diverse materials in diverse thicknesses.

Rigid or soft, deformable and, in this context, in particular windable materials are possible. Covers of this type can, for example, contain or consist of all of the thermoplastics or plastics mentioned and in particular consist of or contain olefin-based thermoplastics, as described above. Correspondingly, these covers can contain the barrier layers and sealing layers described above.

Other covers can, for example, be made of paperboard, paper or cardboard layers, which optionally are covered with at least one plastic layer. A sealing layer can be applied on one or both sides of the paperboard, paper layer or cardboard layer, in particular as cover layers for the particular composite.

Films, film composites and sheet materials or laminates are suitable cover materials, in particular for machine processing. So that these materials remain windable, such films, film composites and sheet materials are as a rule 8 to 1000 μm thick. Examples of such materials are sealable films, for example containing or consisting of high density polyethylene (LLDPE, linear low density polyethylene), medium density polyethylene (LDPE, medium density polyethylene), polypropylene or polyethylene terephthalate, for example in a thickness in the range from 8 to 150 μm, expediently 10 to 100 μm and preferably 70 to 80 μm, optionally also coated with a sealing coating composition, at least on one side.

Other cover materials can be film composites, composed, seen from the inside of the container to the outside, of a sealing layer or a sealing coating composition, as mentioned above, and of a film, for example of a polyethylene terephthalate film, a polyamide film, a polypropylene film or a polyethylene film, which is optionally oriented and which is coated, at least on one side, with a ceramic coating, preferably a $SiO_x$ layer, as described above, and optionally further plastic layers or plastic laminates, in particular the same plastics as the film. The outermost layer can, in turn, be a sealable layer or a colored, printed or reverse-printed layer.

The cover material can be, for example, a cover strip formed of an outer layer of polyethylene terephthalate in a thickness of 12 to 30 μm, a barrier layer of $SiO_x$, where x represents a value from 1.2 to 1.7, and an inner peel-off layer (peel layer) of polypropylene 20 to 50 μm thick. Another cover strip, by way of example, contains a polypropylene film having a thickness of 50 to 100 μm, as outer layer, optionally a barrier layer, preferably of $SiO_x$, where x represents a value from 1.2 to 1.7, and, on the inside, a polypropylene peel-off layer (peel layer) having a thickness of 20 to 50 μm.

Cover materials composed of a polypropylene film or of a polyethylene terephthalate film having a thickness of 70 to 80 μm, optionally containing a ceramic barrier layer, are particularly preferred.

Base sections preferred in practice are, for example, those which have the following structure, from outside to inside: a polypropylene layer, optionally a ceramic barrier layer or a plastic barrier layer, for example consisting of ethylvinyl alcohol, and a polypropylene sealing layer, it being possible for the thickness of the composite to vary between 200 and 400 μm. The ceramic barrier layer in this composite can be a layer of $SiO_x$, where x represents a value from 1.2 to 1.7, located on the plastic layer composed of polypropylene.

Base sections composed of polypropylene or a polyethylene terephthalate film composite having a thickness of 280 to 320 μm, optionally containing a ceramic barrier layer, are particularly preferred.

Circular blanks, which correspond to the base section to be closed, can be produced from the cover materials by punching or cutting out, stacked if appropriate and placed continuously or individually on the base section and sealed on, welded on or stuck on cold or hot. The cover material can also be processed to give continuous material, sheets or rolls, in which case, in order to close the base sections, the cover material is sealed, welded or stuck onto the base section continuously or stepwise and separated off, essentially following the boundary contours of the particular base section.

The fitting of the cover to the particular base sections can be carried out by various methods, for example by sealing, such as hot-sealing or cold-sealing, welding or sticking. The base sections and covers can also be bonded to one another by cold-conquering, for example on the basis of a contact adhesive. Contact adhesives which can be used are the materials customary per se. This prevents or avoids exposure of the packaging, and in particular of sensitive packed materials, such as medicaments, to heat.

Furthermore, the covers can be divided into the segments in various ways.

For example, a cover can be sealed onto the base section, the seal seam being sealed to the base section with the formation of cover segments, around the circumference of each compartment, and a weakening or separation in the form of a tear or separation line in the cover material being produced, at least in part, around the circumference of the individual cover segments.

According to another process, a cover can be sealed onto the base section, the seal seam being sealed onto the base section with the formation of cover segments, around the circumference of each compartment, and weakenings or separations in the form of tear or separation lines already being present, at least in part, around the circumference of each compartment, between the individual cover segments thus formed in the cover material.

The covers, whether in the form of discs or of continuous material, sheets or rolls, can be provided with weakenings or separations in the form of tear or separation lines by mechanical, physical or chemical methods prior to sealing onto the particular base section. The tear or separation lines in the cover should expediently correspond to the separation ridges provided in the base section, centrally and optionally following the edge flange. The weakenings in the cover material can be achieved by partial or complete weakening along the intended tear or separation line or by partial or complete separation through the thickness of a film. In a film composite or laminate, individual layers or all layers can be weakened and/or separated. If separations or weakenings are produced in the cover material prior to sealing, it can be helpful to provide a support or adhesion device on the cover material in order to retain the shape. The cover material which is already segmented or divided into separate sections by weakening lines is temporarily placed on this support or adhesion device. After sealing, the temporary support or adhesion device can easily be removed and optionally re-used. This device can be, for example, a film, a film composite or a dimensionally stable substrate.

It is also possible first to seal the cover material from the area onto the base section along the edge flanges and ridges and after sealing weakenings or separations in the form of tear or separation lines can be produced by mechanical, physical or chemical methods, for example in the centre of the ridges and optionally along the edge flange of the particular base section.

The seal seams can, for example, be 1 to 6 mm, expediently 1.5 to 5 mm and preferably 1.5 to 3.5 mm wide at the edges around each cover segment. The seal seams on the ridges are preferably so wide that when the cover material is separated or weakened after sealing the tool tolerances of the separating device continue to be taken into account and each side of a seal seam divided into two has the abovementioned width. In particular on the ridges, double seal seams can also be provided.

The weakenings or separations can be produced by mechanical means, such as, for example, cutting, punching or scratching with knives, by physical means, for example by heat treatment, laser radiation, electron radiation, spark erosion or incipiently dissolving or swelling using solvents, or by chemical reaction, for example by etching.

The separation or weakening lines must preferably be chosen at least so deep and wide, or tear-resistant, that, at the latest when removing the particular cover segment from the base section, only the relevant cover segment is stripped off, at least around a portion of its circumference. A separation or weakening line which extends only around part, such as ½ to 9/10, preferably ⅓ to ⅞, of the circumference of the cover segment is preferred.

A complete separation of the cover material through its entire thickness is particularly preferred for the formation of cover segments, in order to prevent tearing of the cover segment to be pulled off or of the adjacent cover segment or cover region and to release the packaged material.

Accordingly, preferred blister packs are those in which the cover segments are sealed by means of a seal seam around the circumference of the compartment and have a tear aid in the form of a separation or weakening in the region of the seal seam.

Particularly preferred blister packs are those in which the cover segments are sealed by means of a seal seam around the circumference of the compartment and have a tear aid in the form of a separation or weakening in the region of the seal seam and the separation or weakening extends only over part of the circumference of each compartment.

Very particularly preferred blister packs are those in which the covers are divided into the individual cover segments by means of separation of the cover material.

Blister packs in which the sealed-on cover consists of a film or of a laminate of the same materials as the base section are also preferred.

The seal seams can be produced in a manner known per se. Sealing can be effected by means of heat, high frequency radiation or ultrasound and by means of sealing tools. Typical sealing temperatures are from 100° to 300° C. and expediently from 150° to 250° C. The pressure of the sealing tools can be, for example, from 10 to 400 kg/cm$^2$ and expediently from 40 to 150 kg/cm$^2$. The sealing times can be from 0.2 to 3 sec and appropriately from 0.4 to 2 sec. The seal seams produced under these conditions can easily be pulled off, peeled off or peeled, for example with the formation of a break in cohesion or adhesion. It is also possible, by applying the weakening lines or separation lines and/or seal seams of different thickness, to provide cover segments which cannot be peeled off or pulled off completely. In this way the cover segments of the individual compartments do indeed release the compartment and its contents, but remain adhering to the base section by a portion of the seal seam. In this way it is possible, in particular, to prevent one waste problem, that is to say that the cover segments are thrown away individually, or the compartments can be re-sealable or at least re-closable.

In one possible embodiment, the blister pack can contain a tear-off tongue or tear-off tab on each cover segment of the sealed cover.

Referring to the drawings, in FIG. 1, for example, one corner of a blister pack is indicated, which is to be sealed to the polypropylene base section using an opaque, heat-sealable polypropylene film as cover material having a thickness of about 70 to 80 μm.

Figure 2:
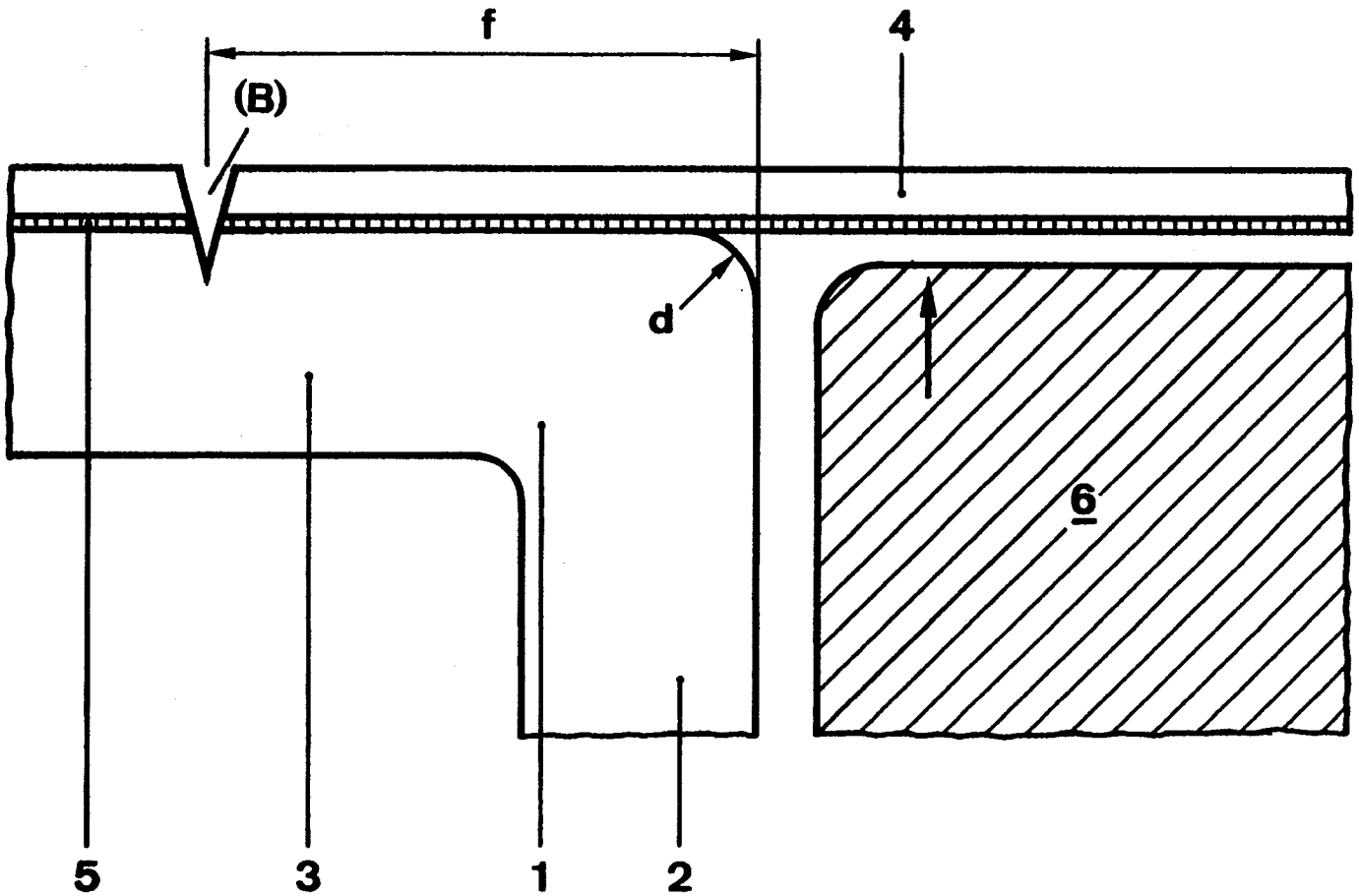
FIG. 2 shows the section through a section of the base section/cover section of a blister pack.

The broken line (A) is intended to indicate a cut from the cover film side through the cover film at least into the base section film, which is, for example, 300 μm thick, see also FIG. 2 cut (B).

The circular cross-section of the cover film, which, for example, can be produced using a Schober rotary punch for rotary machines or using a punch in the form of a steel strip for timed-feed machines, runs around the cup, from (a) to (b).

A cross-section through part of a blister pack is shown in FIG. 2. A base section film (1) forms a recess (2) and a ridge region (3). The base section film can be, for example, a PP film approximately 300 μm thick. A cover material, in the form of a cover film (4) is sealed on in the ridge regions. The cover film (4) can be, for example, a polypropylene film 70 to 80 μm thick, which optionally carries a ceramic barrier layer on the inside, and a hot-seal coating composition (5) on the barrier layer. A tablet (6) is located in the recess (2). The arrow indicated shows the direction of pressure when pressing out the tablet (6).

If the tablet is now pressed out of the interior of the pack from below, the hot-seal coating composition can start to split or peel away from the inside at point (d).

The peel effect continues to the cut (B), the membrane then breaks away and the tablet can be removed from the top.

The construction described can be installed on any molding, filling and sealing machine of modern design. The cut, which represents the separation line, can be made after sealing, using a perforating station, and can thus be made precisely around the cup. A ridge width (f) of, for example, 1.5 mm provides adequate adhesion.

The pack shown by way of example can not be peeled open from the outside, since it is a smooth punched section and there are no possibilities for grasping a peel-off tab.

Figure 3:
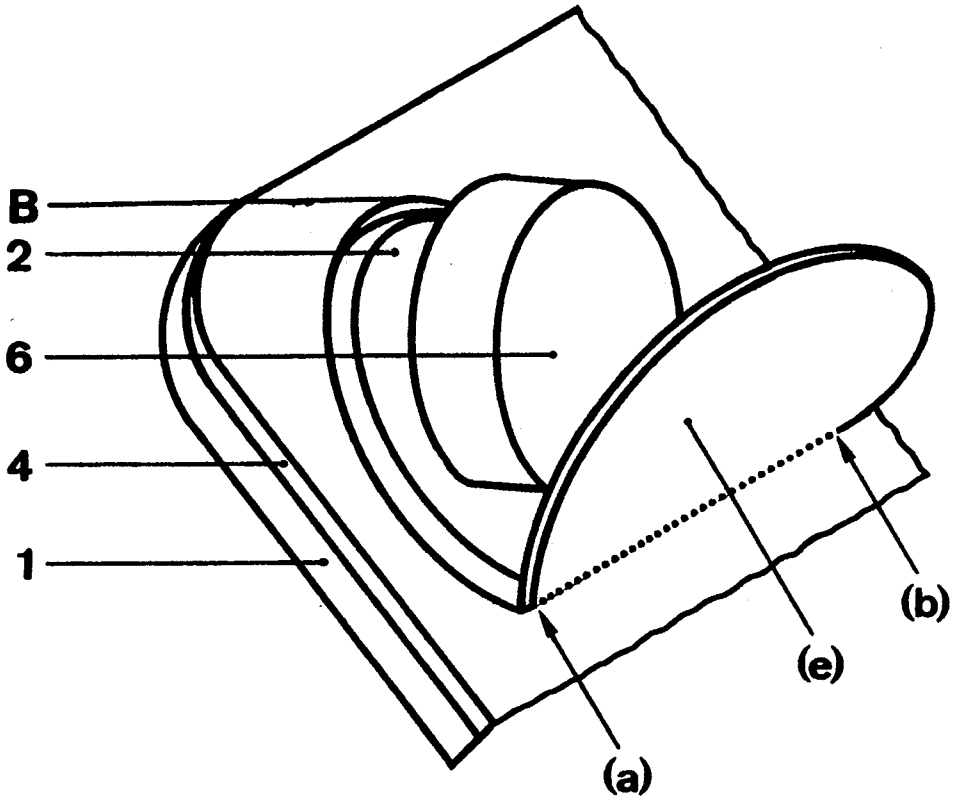
FIG. 3 shows the plan view of a section of exemplary design of an opened blister pack.

FIG. 3 is the plan view of a section of an opened blister pack. The recess (2) for receiving the tablet has been pressed in from below, after which the cover film (4) bursts open along the seal seam up to the cut B and the tablet (6) can be removed. Since the cut B does not go round the entire circumference of the recess (2), the membrane (e) remains attached to the cover film (4) in the region between (a) and (b).

The present invention also relates to the use of packs according to the invention for receiving various packaged goods in separate compartments and for separate removal of the various packaged goods.

The pack is suitable for receiving packaged goods of all types, in tablet-like form and of solid consistency, but in particular for receiving tablets, coated tablets, hard and soft gelatin capsules, confectionary, such as sweets, chewing gum, chocolate and the like, tablet-like products from the diagnostic sector, therapeutic agents and medical auxiliaries. The tablets can be, in particular, luxury foods, cosmetics or pharmaceutical preparations. After filling and before or after sealing on the lids the pack can be sterilized, pasteurized or treated aseptically, for example in the range of the standard sterilisation conditions at 121° C.–130° C., 2.2 bar-3.5 bar and for 30 sec to 30 minutes.

The filled pack can be stored at room temperature, cooled or refrigerated. For removal of the packaged goods, each cover segment can be opened individually, for example according to the removal sequence. Other applications are, for example, packs for portion consumption or selection packaging.

I claim:

1. A blister pack comprising:

a base section containing at least one compartment holding an item to be dispensed;

each said compartment being defined by a recessed portion of said base section and being surrounded by a rim defined by ridge regions of said base section;

a peelable cover positioned over each said compartment and over said rim;

said cover being formed by at least one cover segment having a base adhesively secured to said ridge regions surrounding said at least one compartment;

each said cover segment containing a tear-off aid;

said at least one cover segment due to said tear-off aid being at least partially detachable about a circumference of said at least one compartment by pushing the item in said at least one compartment through said at lest one cover segment without the need to manually remove any part of said cover segment from said pack;

the base section and said cover being formed from materials essentially consisting of the same types of plastics; and said tear-off aid comprising a substantially V-shaped notch which extends through said cover and partially into said rim.

2. Blister pack according to claim 1 wherein the base section and said cover are formed from identical materials.

3. Blister pack according to claim 1 wherein the base section and said cover are formed from different materials.

4. Blister pack according to claim 1 wherein the base section has more than two compartments, the cover is divided into a number of cover segments equal to the number of compartments, and each cover segment covers one of said compartments.

5. Blister pack according to claim 1 wherein the at least one cover segment is sealed by means of a seal seam around the circumference of the at least one compartment and said substantially V-shaped notch forming a weakening in the region of the seal seam.

6. Blister pack according to claim 1 wherein the at least one cover segment is sealed by means of a seal seam around the circumference of the at least one compartment and said substantially V-shaped notch forming a weakening in the region of the seal seam which extends only over part of the circumference of each said compartment.

7. Blister pack according to claim 1 wherein the cover is divided into individual cover segments by means of separation of the cover material.

8. Blister pack according to claim 1 wherein the cover consists of a film or of a laminate of the same material as the base section.

9. A blister pack according to claim 1 for receiving multiple units of tablet-like packaged goods in separate compartments and for individual removal of each unit of the tablet-like packaged goods.

* * * * *